US008533988B2

(12) United States Patent
Ziegler

(10) Patent No.: US 8,533,988 B2
(45) Date of Patent: Sep. 17, 2013

(54) SIGHTING TELESCOPE MOUNTING SYSTEM FOR A FIREARM

(76) Inventor: Gerhard Ziegler, Georgensgmünd (DE)

( * ) Notice: Subject to any disclaimer, the term of this patent is extended or adjusted under 35 U.S.C. 154(b) by 10 days.

(21) Appl. No.: 12/970,410

(22) Filed: Dec. 16, 2010

(65) Prior Publication Data

US 2011/0146131 A1 Jun. 23, 2011

(30) Foreign Application Priority Data

Dec. 22, 2009 (DE) ..... 10 2009 060 660
Jan. 22, 2010 (DE) ..... 10 2010 005 588

(51) Int. Cl.
*F41G 1/00* (2006.01)

(52) U.S. Cl.
USPC ..... 42/124; 42/126; 42/127; 42/148

(58) Field of Classification Search
USPC ..... 42/124–128, 148
See application file for complete search history.

(56) References Cited

U.S. PATENT DOCUMENTS

| | | | | | |
|---|---|---|---|---|---|
| 1,837,290 | A | * | 12/1931 | Redfield | 42/127 |
| 2,306,972 | A | * | 12/1942 | Meisel | 42/125 |
| 2,641,057 | A | * | 6/1953 | Moore | 42/127 |
| 2,942,346 | A | * | 6/1960 | Heinrich | 42/127 |
| 3,463,430 | A | * | 8/1969 | Jimenez et al. | 42/124 |
| 3,750,318 | A | * | 8/1973 | Burris | 42/127 |
| 3,785,603 | A | * | 1/1974 | Apel | 248/222.13 |
| 3,877,166 | A | * | 4/1975 | Ward | 42/127 |
| 3,880,389 | A | | 4/1975 | Burris | |
| 4,205,473 | A | * | 6/1980 | Wilson | 42/127 |
| 4,249,315 | A | * | 2/1981 | Hopson, III | 42/125 |
| 4,310,980 | A | * | 1/1982 | Pilkington | 42/127 |
| 4,353,180 | A | * | 10/1982 | Wilson | 42/127 |
| 4,934,085 | A | * | 6/1990 | Lough | 42/127 |
| 4,959,908 | A | * | 10/1990 | Weyrauch | 42/124 |
| 5,035,487 | A | * | 7/1991 | Herz | 359/896 |
| 5,070,637 | A | | 12/1991 | French | |
| 5,111,587 | A | * | 5/1992 | Plank | 42/127 |
| 5,274,941 | A | * | 1/1994 | Moore | 42/126 |
| 5,390,419 | A | * | 2/1995 | Sirkis | 42/127 |
| 5,396,725 | A | * | 3/1995 | Talbot | 42/127 |
| 5,400,539 | A | * | 3/1995 | Moore | 42/127 |
| 5,680,725 | A | * | 10/1997 | Bell | 42/127 |
| 5,787,630 | A | * | 8/1998 | Martel | 42/125 |

(Continued)

FOREIGN PATENT DOCUMENTS

| | | | |
|---|---|---|---|
| DE | 1578319 | A1 | 11/1971 |
| DE | 7 524 622 | U | 2/1976 |

(Continued)

*Primary Examiner* — Michelle Clement
(74) *Attorney, Agent, or Firm* — Lucas & Mercanti, LLP

(57) ABSTRACT

A sighting telescope mounting system for a firearm for mounting a sighting telescope onto the firearm in a desired position, wherein the firearm and/or the sighting telescope are aligned in the desired position in an axial direction, with an arresting foot which can be attached to the sighting telescope and with an arresting holding device which can be affixed to the firearm. The arresting foot has at least one support area and the arresting holding device has at least one connection area, wherein due to the support area and the connection area in a contact area, a form-fit connection of the arresting foot on the arresting holding device is attained in a first radial direction. The arresting foot and the arresting holding device form an arrest which detachably affixes the arresting foot in the other radial direction.

15 Claims, 9 Drawing Sheets

(56) References Cited

U.S. PATENT DOCUMENTS

| | | | | |
|---|---|---|---|---|
| 6,594,938 | B2 * | 7/2003 | Horton | 42/127 |
| 6,922,934 | B1 * | 8/2005 | Huan | 42/127 |
| 7,140,143 | B1 * | 11/2006 | Ivey | 42/125 |
| 7,308,772 | B1 * | 12/2007 | Millett | 42/127 |
| 7,543,405 | B1 * | 6/2009 | Ivey | 42/125 |
| 7,562,485 | B2 * | 7/2009 | Newhall et al. | 42/127 |
| 7,827,724 | B1 * | 11/2010 | Spinelli | 42/124 |
| 7,908,782 | B1 * | 3/2011 | LaRue | 42/128 |
| 7,971,384 | B2 * | 7/2011 | Lippard | 42/124 |
| 8,079,171 | B2 * | 12/2011 | Barrett | 42/125 |
| 8,136,287 | B2 * | 3/2012 | Adams | 42/124 |
| 2003/0056417 | A1 | 3/2003 | Horton | |
| 2008/0092421 | A1 * | 4/2008 | Beckmann | 42/90 |
| 2010/0263256 | A1 * | 10/2010 | Spinelli | 42/124 |
| 2011/0061286 | A1 * | 3/2011 | Wang | 42/125 |

FOREIGN PATENT DOCUMENTS

| | | | |
|---|---|---|---|
| DE | 3 204 152 | A1 | 8/1983 |
| DE | 9406408 | | 7/1994 |
| DE | 29802854 | | 8/1998 |
| DE | 20 2006 004542 | U1 | 6/2006 |
| DE | 10 2005 005 232 | A1 | 8/2006 |
| DE | 102005005232 | | 8/2006 |
| GB | 853182 | A1 | 11/1960 |
| WO | 93/15371 | A1 | 8/1993 |

* cited by examiner

SIGHTING TELESCOPE MOUNTING SYSTEM FOR A FIREARM

The present application claims priority of DE 10 2009 060 660.2, filed Dec. 22, 2009, and DE 10 2010 005 588.3, filed Jan. 22, 2010, the priority of these applications is hereby claimed and these applications are incorporated herein by reference.

BACKGROUND OF THE INVENTION

The invention relates to a sighting telescope mounting system for a firearm for mounting a sighting telescope onto the firearm in a desired position, wherein the firearm and/or the sighting telescope are aligned in the desired position in an axial direction, with an arresting foot which can be attached to the sighting telescope and with an arresting holding device which can be affixed to the firearm, wherein the arresting foot comprises at least one support area and the arresting holding device comprises at least one connection area, wherein due to the support area and the connection area in a contact area, a form-fit connection of the arresting foot on the arresting holding device is attained in a first radial direction, and wherein the arresting foot and the arresting holding device form an arrest which detachably affixes the arresting foot in the other radial direction.

Sighting telescopes are frequently used for firearms, particularly weapons, which are designed as a telescope with a sighting mechanism which is integrated in the optics. The sighting mechanism and the firearm must be adjusted (zeroed in) in order to ensure that with the sighting mechanism, the sight is focused on a real penetration point of a projectile fired using the firearm.

In practise, however, it is sometimes necessary to separate the sighting telescope and the firearm from each other. This necessity can arise for example during transportation or storage. In order to be able to attain a reproducible mounting of the sighting telescope on the firearm after dismantling without renewed zeroing in, sighting telescope mounting systems are used which enable a simple separation and re-mounting of the sighting telescope on the firearm in the zeroed in position.

At least two different types of sighting telescope mounting systems are known for hunting weapons:

For example, document DE 9406408 relates to a mounting system for a "pivot rotary mounting" of a sighting telescope, wherein a front centre pin of the mounting system is inserted into a front base of a firearm and the sighting telescope is pivoted by 90°. A rear pin is inserted into a side notch during the pivot movement and is locked in place using a hand lever. A similar mounting system is also disclosed in document DE 10 2005 005232 A1.

A highly traditional type of mounting is the "Suhler claw mount" (SEM). With the Suhler claw mount, the mounting foot which is attached to the lens head of the sighting telescope is hooked into a front base plate on the firearm. After being pressed down briefly and firmly, the rear mounting foot which is affixed on the central tube of the sighting telescope latches into a rear mounting plate. In order to again remove the sighting telescope, a springed slide which is attached to the rear base plate must be drawn back as a result of which the lock on the rear foot is released and the sighting telescope can be unhooked. The Suhler claw mount is regarded as being one of the most expensive sighting telescope mounting systems since it requires highly complex fitting work. Each individual fitting surface must be reworked separately and manually in order to provide a precise seat for the sighting telescope in a desired position. Reference is made to the Suhler claw mount in document DE 29802854 U1, for example, which is assumed to be the closest prior art as a result.

SUMMARY OF THE INVENTION

The object of the invention is to recommend a sighting telescope mounting system for a firearm which enables reproducible assembly and dismantling of the sighting telescope on the firearm. This object is attained by means of a sighting telescope mounting system with the features described herein. Preferred or advantageous embodiments of the invention are also included in the description below and the appended figures.

Within the scope of the invention, a sighting telescope mounting system is recommended which is design to affix a sighting telescope to a firearm, in particular a hand firearm, specifically a hunting or sports weapon. The sighting telescope mounting system makes it possible to mount the sighting telescope on the firearm, to dismantle it and re-mount it in a reproducible manner. In particular, during the assembly-dismantling-assembly procedure, an adjusted position of the sighting telescope on the firearm is maintained or restored. This adjusted position of the sighting telescope on the firearm—also known as the zeroed-in position—will be referred to below as the desired position and denotes the position in which a target device of the sighting telescope sights in a congruent manner a penetration point of a projectile which has been fired from the firearm at a certain distance, such as 100 meters.

The longitudinal extension of the firearm and/or of the sighting telescope in the desired position will be referred to below as the axial direction. A radial direction relates to this axial direction below. A transverse direction here denotes a direction which is arranged both vertically to the axial and to the radial direction at a point which is at a radial distance from an axially aligned axis of the firearm. The axially aligned axis is defined for example by the shooting direction in the barrel of the firearm.

The sighting telescope mounting system preferably comprises two mechanical interfaces between the firearm and the sighting telescope, wherein one mechanical interface serves to arrest the sighting telescope on the firearm. It is preferred, with regard to the shooting direction, that the mechanical interface be arranged at the rear for the arrest, i.e. facing the user. The other mechanical interface is preferably designed in such a manner that it permits a swinging out of the sighting telescope which is mounted on the firearm, at a plane which is formed by the sighting telescope and the axial direction of the firearm. In terms of the type of mount, the sighting telescope mounting system is thus highly similar to the "Suhler claw mount". With alternative embodiments, the position of the two interfaces is interchanged and is thus similar to the "contra claw mount".

The sighting telescope mounting system comprises an arresting foot which can be attached to a sighting telescope, and an arresting holding device which can be affixed to the firearm. When the sighting telescope is released from the firearm, the arresting foot remains in the sighting telescope and the arresting holding device remains in the firearm. A vice-versa design is also feasible within the scope of the invention, wherein the arresting foot can be attached to the firearm and the arresting holding device can be attached to the sighting telescope.

It is particularly preferred that the arresting holding device be designed as a mounting plate, which is affixed in a form-fit manner on the firearm, in particular firmly bolted, and as an optional addition is firmly bonded, for example by soldering.

The arresting foot comprises at least one support area, wherein the support area can be divided into different individual sections, while by contrast, the arresting holding device has at least one support area which can also be distributed over several individual areas. In the desired position in a contact area, the support area and the connection area create a form-fit connection for the arresting foot on the arresting holding device in a first radial direction. In particular, the contact area forms an end stop when the sighting telescope is swung back in around the other mechanical interface on the firearm.

As a further function, the arresting foot and the arresting holding device form an arrest which detachably affixes the arresting foot in the other radial direction, i.e. in the swing open direction, in the desired position. Preferably, further components are used in the arresting foot—arresting holding device assembly, such as a latch or a slide.

According to the invention, it is recommended that the support surface and the connection surface are designed in such a manner that the arresting foot can be arrested in the arresting holding device in different angle positions around at least one pivot axis relative to the arresting holding device. As a result, the arresting foot is retained securely and/or in a reproducible position in the arresting holding device when the arresting foot is turned around at least one pivot axis opposite the arresting holding device. Preferably, the angle positions extend in an overall range of at least 0.01°, preferably at least 0.1° and in particular at least 0.4°.

Here, one consideration of the invention is that the affixation of the sighting telescope on the firearm can be distributed over the two mechanical interfaces, wherein when position deviations of the two mechanical interfaces from an ideal position occur, the arrestor can be mounted without adjustment work, as has been the case to date.

A first possible pivot axis is formed by a yaw axis, so that the arresting foot can be arrested around a radially aligned pivot axis relative to the pivot holding device. This angle tolerance can become important with a non-aligned arrangement in the direction of travel or the axial direction of the interfaces.

A second possible pivot axis is formed by a roll angle axis, so that the arresting foot can be arrested in a twisted manner around a pivot axis which is aligned in the direction of travel relative to the arresting holding device. This angle tolerance can become important when the interfaces are twisted towards each other. This option is not absolutely necessary with some sighting telescopes, since they have a transverse adjustment (Q) and/or a rotation setting option for the sighting telescope around its own axis. The angle tolerance around the roll angle axis can thus also be achieved by transverse positioning and/or the rotation setting option. By contrast, telescopes are also known which do not have these setting options, such as sighting telescopes with a firmly attached track system as an interface to the sighting telescope mounting system. With these embodiments, the angle tolerance with regard to the roll angle is particularly advantageous.

A third possible pivot axis is formed by a pitch angle axis, so that the arresting foot is arrested in a twisted manner relative to the arresting holding device around a pivot axis which is preferably aligned vertically to the axial extension and to the radial extension. This angle tolerance can become important when the interfaces are pitched towards each other.

Within the scope of the invention, the at least one pivot axis can comprise any one, or any two, or all three of the options described. It is also within the scope of the invention that an at least unidimensional, preferably two-dimensional and in particular, three-dimensional pivot of the arresting foot is included in a mathematical system which is analogue or equivalent. For example, the arrest could be formed by a ball socket-type joint and/or a rocker-type holding device.

In another version, the arrest is preferably designed in such a manner that the pivot of the arresting foot around one of the pivot axes which runs through the arresting holding device, in particular through the support area and/or connection area and/or contact area, is tolerated relative to the arresting holding device. In other words, the arresting foot has a degree of play with regard to the rotation or pivot described relative to the arresting holding device.

As an alternative or a supplement it is ensured that correct mounting is also possible even when the arresting foot and arresting holding device are pivoted or twisted towards each other around a or the radially aligned axis or another of the possible pivot axes. This angle-tolerant retention of the arresting foot in the arresting holding device enables a deviation from a parallel alignment of the arresting foot and the arresting holding device with some embodiments by more than 0.01°, preferably by more than 0.1°, and in particular by more than 0.4°, and specifically by up to 3° or more.

This advantageous further development is based on the consideration that the two mechanical interfaces usually do not exactly align in the desired position in the axial direction, but can be displaced in relation to each other e.g. in the transverse direction. Due to the angle-tolerant retention of the arresting foot in the arresting holding device, the installation and initial adjustment, i.e. the zeroing in, of the sighting telescope mounting system is made significantly easier, since the transverse displacement described or another displacement has no effect, or only a negligible effect, on the arrestor.

With one advantageous further development of the invention, the arresting foot is movable in the axial direction and held in a form-fit manner in the transverse direction. The movement in the axial direction is preferably possible by at least 0.1 mm, in particular by at least 1 mm, and specifically, by at least 2 mm.

Within the scope of the further development, the axial positioning of the firearm is defined by the other mechanical interface, so that during arresting, the arresting foot does not have to be defined in the axial direction, and thus forms a loose bearing in this direction and/or has a degree of play in the axial direction. By contrast, however, it is ensured that the arresting foot is held in a defined manner in the transverse direction, and preferably also upwards, i.e. in the radial direction. With the further development, a low-voltage mounting of the sighting telescope on the firearm is made possible due to the fact that an overdefinition of the mounting system in the axial direction is avoided.

With one preferred structural realisation of the invention, the contact area is formed by a plurality of point and/or line contacts, which implement the form-fit hold in the transverse direction. Preferably, at least or precisely two point or line contacts are used. In order to achieve the angle tolerance of the arrestor, it is preferred that the line contacts be rectified with the radial axis. Due to the rectification of the radial axis and the line contacts, it is possible to displace the line contacts during a pivot around the radial axis without obtaining a form-fit block in the pivot direction. In one embodiment which is close to reality, a preferred precise parallel alignment of the line contacts and the radial axis will not be able to be realised in multiple terms, so that the same alignment also implements this invention concept.

With one possible structural design of the invention, the connection area and/or the support area are designed in one profile which is vertical to the axial direction of the firearm and/or the sighting telescope in such a manner that they form one or more funnel sections. The funnel sections are aligned in such a manner that they implement a centring or self-centring of the arresting foot in the arresting holding device. Should, in functional terms, the connection area be designed as a female connector and the support area as a male connector, it is preferred that the funnel section(s) taper in the direction leading away from the sighting telescope to the firearm. In the reverse case with regard to the female and male connector, the funnel direction should also be reversed, so that the centring effect and the mechanical compatibility are ensured.

With one structural realisation of the invention, the walls of the funnel section or the funnel section are designed to run in a straight or curved manner in the profile of the connection area and/or support area. A plurality of combination options are available for this purpose:

When the touching walls of the funnel section of the connection and support area both run in a straight line and are arranged in parallel to each other, a line contact is formed. The same applies when in the contact area, both touching walls are formed with the same curvature radius and are curved in the same direction. With other embodiments, one of the walls is straight and the other wall is curved, in particular designed in a convex manner, so that a point contact results. The role of the convex wall can include both the connection area and the support area. It is also possible that the touching walls be curved in the same direction with different curvature radii, e.g. in terms of an osculation, so that a point contact is also formed. As a further alternative, the touching walls can be curved in a convex-convex manner, which also results in a point contact.

In a longitudinal section through the contact area parallel to the axial direction, namely through the contact area, the connection area is preferably aligned in such a manner that it runs straight, in particular in parallel to the axial direction. This straight progression forms the basis for the axial degree of play of the arresting foot in the arresting holding device, wherein the arresting foot is movable on the connection area in the axial direction.

In the same longitudinal section through the contact area parallel to the axial direction, the support area shows two support flanks which are curved in the same direction, and which are both curved outwards in a convex manner. The curvature of the support flanks can be sections of a shared circle or sections of a circle arc digon lens, i.e. an intersection-type form which is generated when two circles partially overlap and together form a section area. This can however also be sections of an oval, a shuttle form or a lemon form. It is also possible that not only sections of the named forms, but also the complete forms, can be created by the support flanks. In a particularly preferred manner, the two support flanks are formed in a mirror-symmetrical manner to a symmetry axis parallel to the axial direction.

In particular when—as will be shown below—the arresting foot has more than one hook section with support areas, the support areas can take on similar forms to those described above, but are preferably designed as free-form surfaces. Specifically, the support areas of a hook section are designed to be asymmetrical to each other to a symmetry axis parallel to the axial direction.

Due to the combination of a connection and a straight progression in the longitudinal section and a support area which has curved support flanks, the support area and the connection area can be pivoted towards each other around the aforementioned radial axis or more generally around the yaw axis, roll axis and/or pitch axis by a low degree angle, e.g. in a range between 0.01 and 3 degrees, wherein the contact areas move along the support areas or connection areas, while at the same time still implementing the form-fit function.

It is also feasible that the structural design of the connection area and the support area can be interchanged, so that the support area runs straight and the connection area accordingly has a curved design. It is also possible for both the connection area and the support area to have a curved design in the longitudinal section.

As an alternative or a supplement to this, the support area forms a mushroom head, a tapered head or a shuttle, or sections of these. In particular when the arresting foot on the arresting holding device is held only by a funnel section or two walls of the funnel section, it is preferred that the support area be designed as a rotation symmetrical area, wherein the radial axis of the pivot is then guided through the symmetry axis.

In particular when—as is preferred—an arresting holding device is provided with two funnel sections or an arresting foot which also has two funnel sections which correspond to it, it is preferred that the form of the support area be extended in a longitudinal form towards the axial direction.

The arresting foot can comprise precisely one hook section. With one possible further development of the invention, the arresting foot comprises at least two, or precisely two, hook sections, wherein the support area is arranged on at least one hook section. Preferably, the support area is arranged on both hook sections, or distributed over both hook sections, wherein the hook sections in the support section can respectively comprise the form described above. It is particularly preferred that the arresting holding device comprise a holding device for the arresting foot with at least two, or precisely two, slits.

In order to implement the arrest in the other radial direction, it is preferred that the arresting holding device comprise a locking slide which can be inserted into holding areas of the hook sections on a longitudinal section plane. Due to the insertion of the locking slide into the holding areas, form-fit fixation of the arresting, foot in the opening direction of the arrestor is achieved.

With one possible realisation, the sighting telescope mounting system comprises a pivot device as the other interface, with a pivot foot and a pivot holding device, which together form a pivot joint, wherein during the mounting of the sighting telescope, the pivot joint enables a pivot of the sighting telescope by a pivot angle around a pivot range on a plane which is formed by the sighting telescope and the axial direction of the firearm.

Preferably, the pivot device forms a fixed bearing for the transverse direction and in the axial direction, as well as upwards, wherein however with the pivot device, a degree of play with regard to the pivot angle remains, since the pivot angle is defined by the arrest.

In preferred embodiments, the arresting foot can be diagonally removed or de-formed from the arresting device. In further preferred embodiments, the contact areas form the sole position-defining tangency areas between support surfaces and connection surfaces, in particular in the transverse direction (Q) and in the radial direction in the closing pivot direction.

Further features, advantages and effects of the invention will be included in the description of a preferred exemplary embodiment of the invention below.

BRIEF DESCRIPTION OF THE DRAWING

The same parts, or parts which correspond to each other, are respectively assigned corresponding or the same reference numerals.

DETAILED DESCRIPTION OF THE INVENTION

Figure 1A:
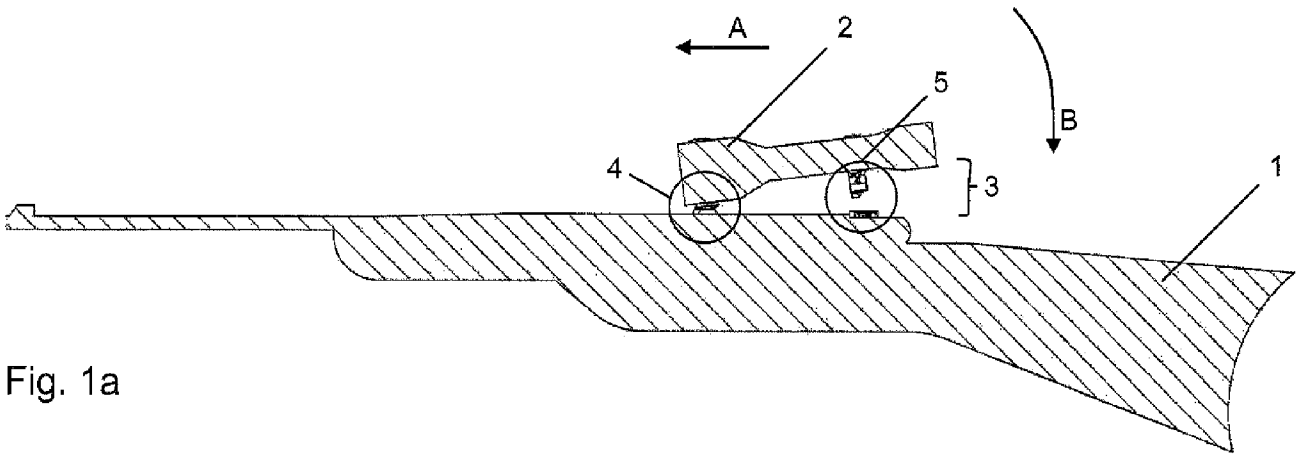
FIGS. 1*a, b* show a schematic side view onto a firearm with the mounting system as a first embodiment of the invention during mounting
Figure 1B:
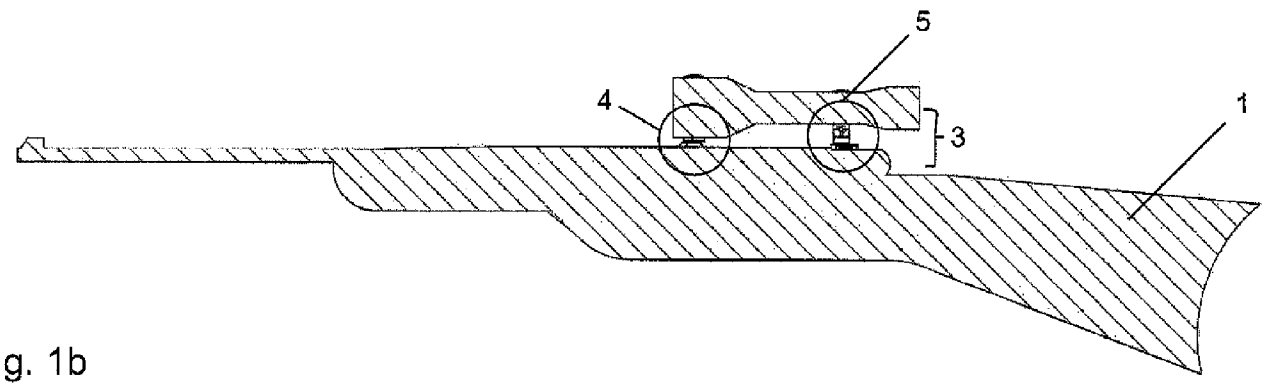

FIGS. 1*a* and 1*b* show in a schematic cross-section view a firearm 1 which is designed as a hunting weapon, to which a sighting telescope 2 is mounted. In order to couple the sighting telescope 2 to the firearm 1, a sighting telescope mounting system 3 is provided which comprises a front attachment area 4 and a rear attachment area 5. During the mounting procedure, the sighting telescope 2 is first hooked in the direction of the arrow A in the front attachment area 4, and then pivoted by a pivot angle using a pivot movement around the front attachment area 4 according to arrow B, so that the rear attachment area 5 is arrested. The pivot is here conducted on the sheet plane in FIGS. 1*a, b*, on which both the axial extension of the firearm 1 and the axial extension of the sighting telescope 2 lies.

Figure 2:
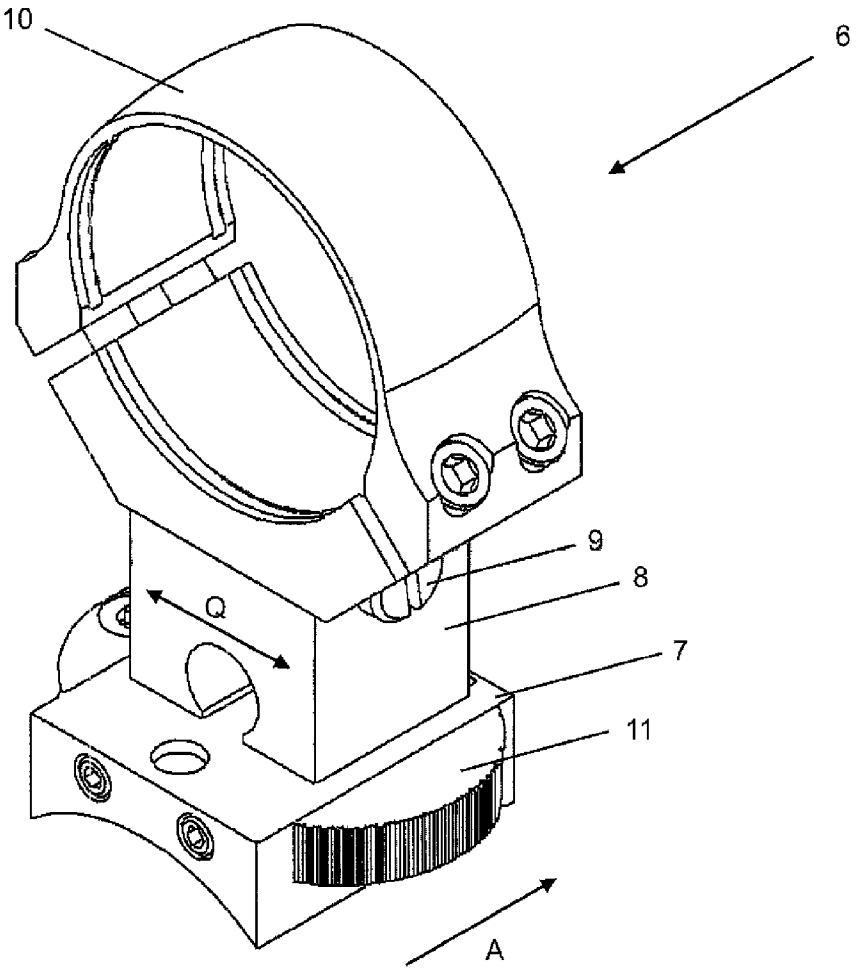
FIG. 2 shows a schematic three-dimensional view of the arresting area of the mounting system shown in FIG. 1

FIG. 2 shows in a schematic three-dimensional view an arresting device 6 which is arranged in a rear attachment area of the mounting system 3, in an arrested state. The arresting device 6 comprises an arresting holding device 7 which is affixed on the firearm 1. In the arresting holding device 7, an arresting foot 8 is inserted and arrested, the precise structure of which will be explained below. The arresting foot 8 is coupled via an adjustment device 9 with a ring holding device 10 which grips and holds the circumference of the sighting telescope 2. When the ring holding device 10 is loosened, the sighting telescope 2 can be turned around its own axis and thus adjusted. The adjusting device 9 serves to alter or adjust the ring holding device 10 relative to the arresting foot 8 in a transverse direction Q. In the arresting holding device 7, a locking slide 11 is arranged which can be moved towards the axial direction A in order to loosen the arrest of the arresting foot 8 in the arresting holding device 7.

Figure 3:
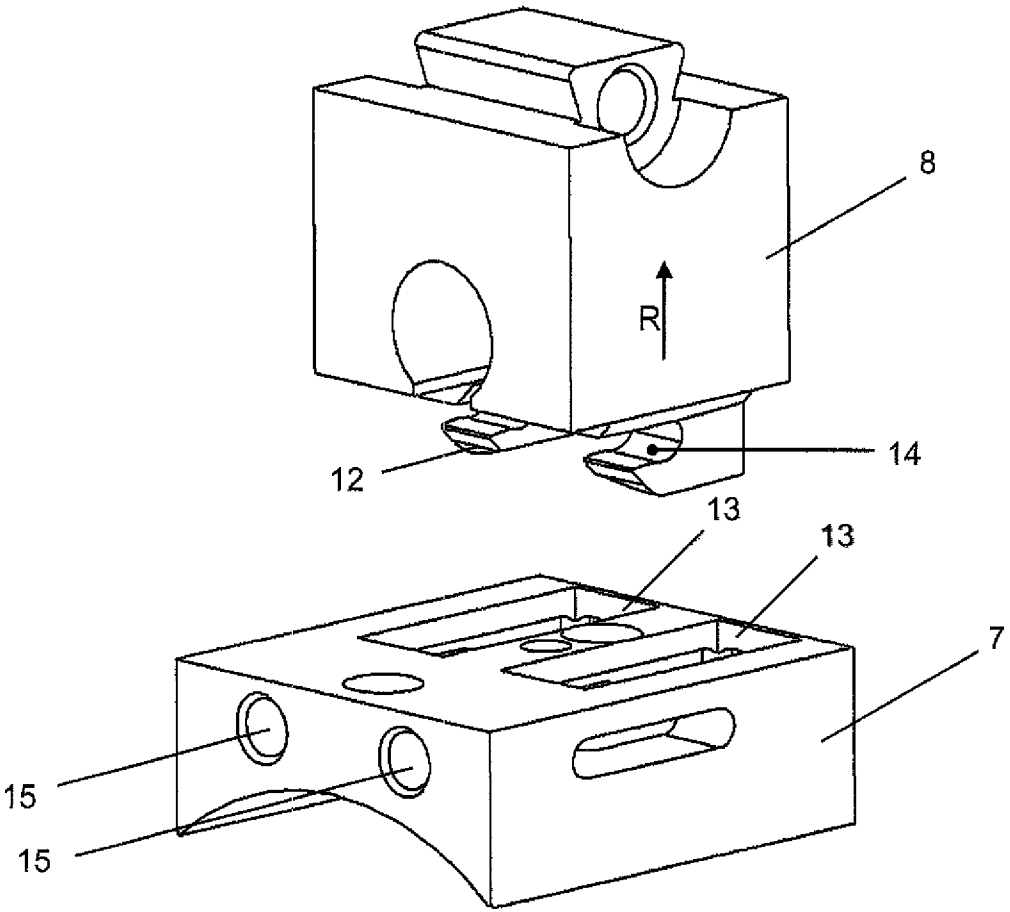
FIG. 3 shows two components of the arresting device shown in FIG. 2 in a similar view, but in an enlarged view

FIG. 3 shows in a schematic three-dimensional view the arresting foot 8 and the arresting holding device 7 in an enlarged view. The arresting foot 8 comprises two hook sections 12 which can be inserted into corresponding slits 13 of the arresting holding device 7. The hook sections 12 are attached as a single piece to the arresting foot 8 and comprise holding areas 14 into which the locking slide 11 grips during locking resulting from a movement in direction A, so that the arresting foot 8 is blocked in a form-fit manner against a movement in the radial direction R to the axial direction A. It should also be noted that the locking slide 11 and the holding areas 14 are designed to be self-impeding, and the locking slide 11 is pre-tensioned via spring elements in the openings 15, not shown, in the direction of the hook sections 12.

When mounting the sighting telescope 2 of the firearm 1, the hooking-in procedure is first conducted, and the arresting foot 8 is subsequently inserted into the slits 13 of the arresting holding device 7 and there locked using the locking slide 11.

Figure 4:
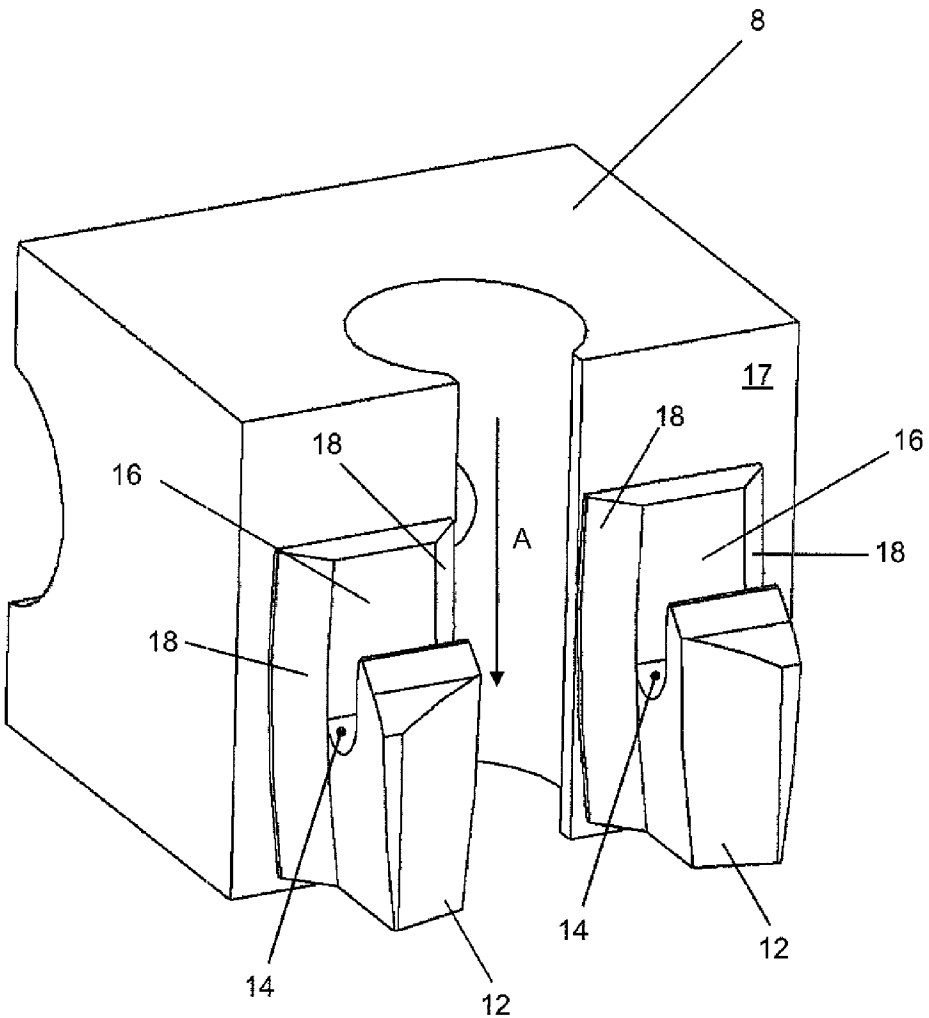
FIG. 4 shows a three-dimensional top view from diagonally below onto a component of the arresting device shown in the preceding figures

FIG. 4 shows a three-dimensional view of the arresting foot 8 from below, in order to better explain the structure of the hook sections 12.

The hook sections 12 comprise a foot area 16 which comprises support surfaces 17 which extend in the radial direction A and which are angled in relation to an underside 18 of the arresting foot 8 by approx. 45°. Two support surfaces 18 are arranged in each foot area 16.

The mounting system 3 is designed in such a manner that a form-fit support of the arresting foot 8 on the arresting holding device 7 is provided only on the support surfaces 18, but not on the underside 17 of the arresting foot 8. Furthermore, the hook sections 12 or the support surfaces 18 or the arresting foot 8 in the arresting holding device 7 are freely movable in the axial direction A up to the restriction resulting from the locking slide 11. In this embodiment, the arresting foot 8 is held in the transverse direction Q and forms an end stop for the pivot movement according to arrow B in FIG. 1, although it is a loose bearing in the axial direction A.

Figure 6:
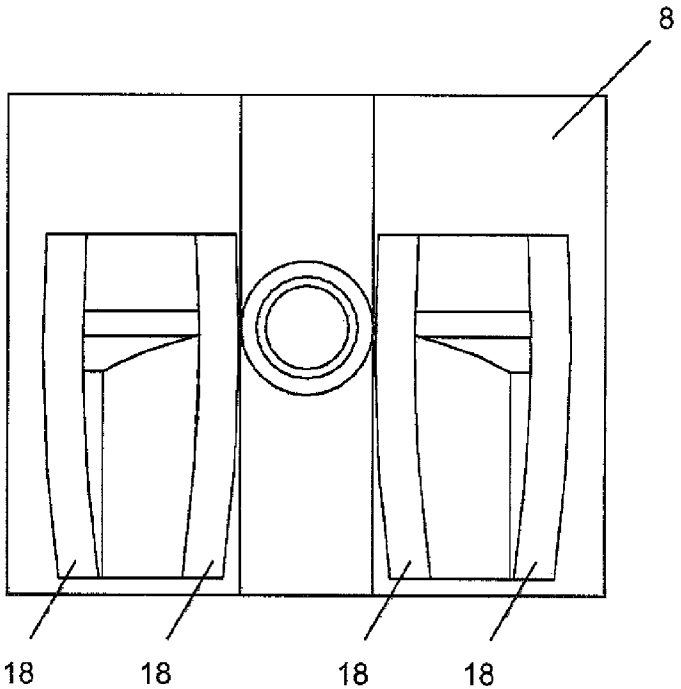
FIG. 6 shows a top view from below onto the arresting foot of the mounting system shown in the preceding figures
Figure 5:
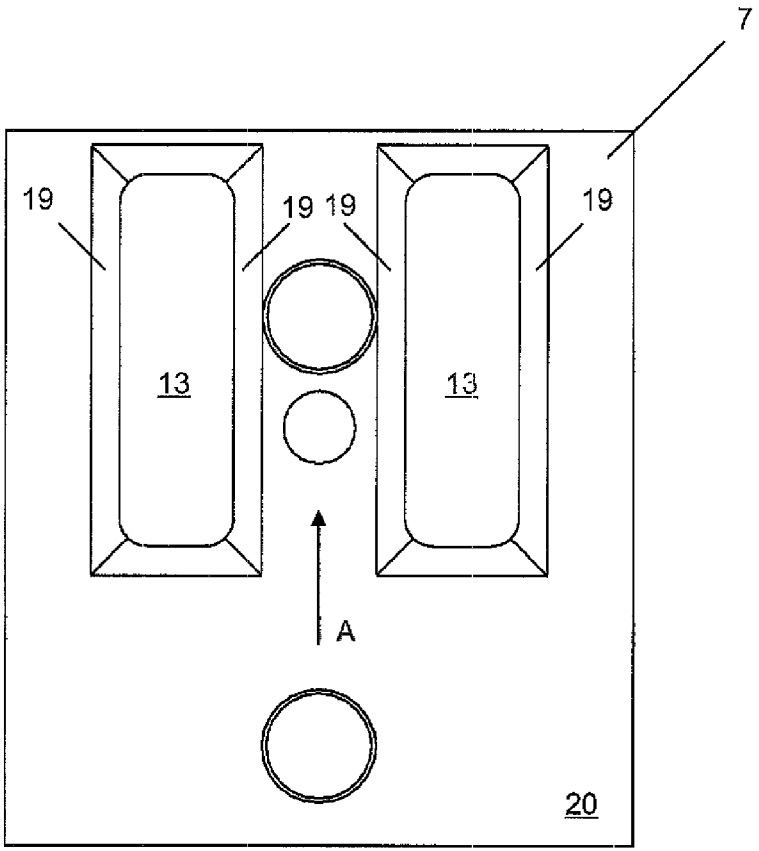
FIG. 5 shows a top view onto the arresting holding device of the mounting system shown in the preceding figures

FIGS. 5 and 6 show a top view of the arresting holding device 7 or a view from below of the arresting foot 8. As can be seen in the drawing in FIG. 6, the support surfaces 18 do not extend in a straight line, but are curved towards each other in pairs. In the edge areas of the slits 13, connection surfaces 19 which correspond to them are arranged which are set at an angle of approx. 45° to the upper side 20 of the arresting holding device 7. In contrast to the support surfaces 18, the connection surfaces 19 run in the axial direction A. The connection surfaces 19 form a V-shaped holding device for each slit 13 in a cross section to the axial direction A.

Figure 7:
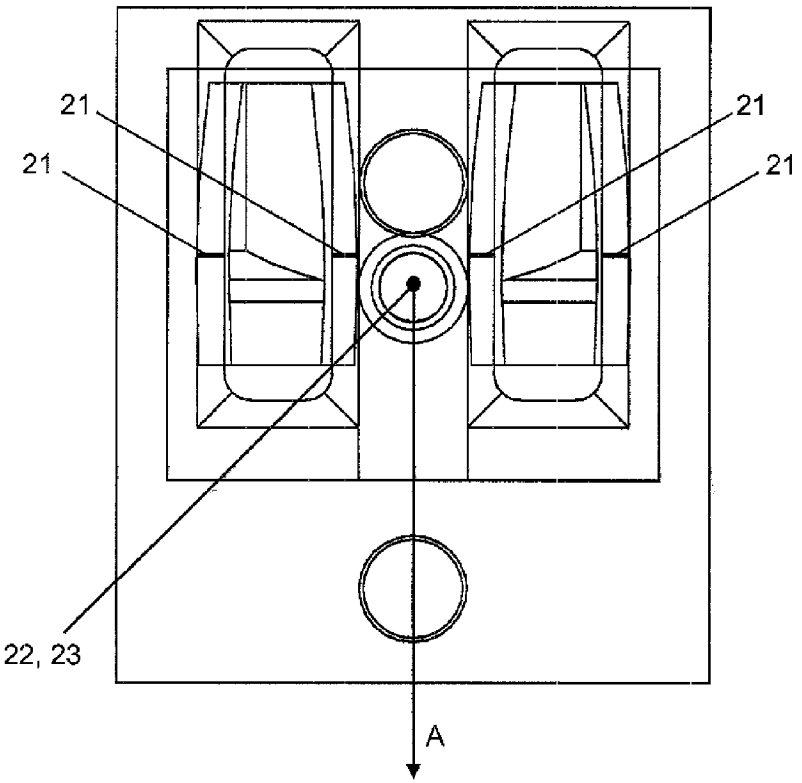
FIG. 7 shows a top view onto the arresting holding device when the arresting foot is attached in an aligned position

With a contact in the ideal alignment of the arresting foot 8 and arresting holding device 7, contact lines 21 are formed which together form a contact area between the support area of the support surfaces 18 and the connection area of the connection surfaces 19. With an ideal alignment in the axial direction A, all contact lines 21 are at the same height. This situation is shown in FIG. 7, in which the arresting foot 8 is shown attached to the arresting holding device 7.

Figure 8:
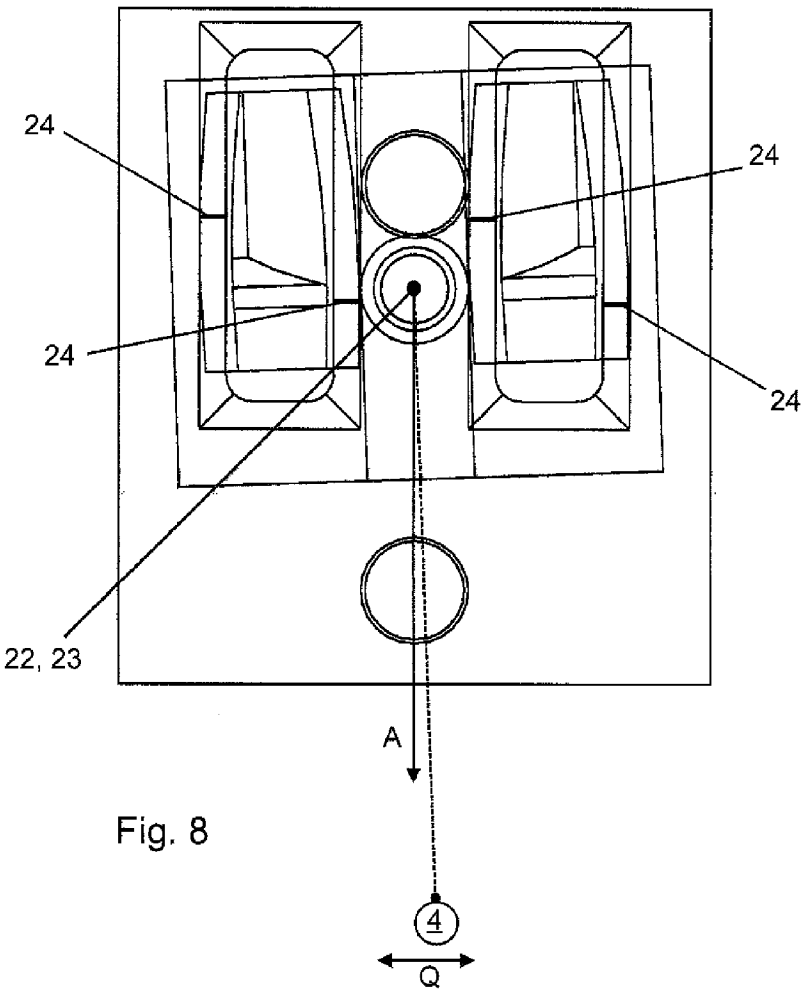
FIG. 8 shows the arrangement in FIG. 7 when the arresting holding device and arresting foot are turned around a yaw angle axis.

When the arresting foot 8 is turned on the arresting holding device 7 around a radially aligned rotation axis, which runs for example through the through bores 22 of the arresting holding device 7 or 23 of the arresting foot 8, the contact lines 21 are displaced and form new contact lines 24 which again ensures a secure support, as is shown in FIG. 8. The resulting angle tolerance of the arresting device 6 in relation to the rotation around the radially aligned rotation axis (yaw angle axis) or the pitch angle axis is achieved by the curved form of the support surfaces 18, wherein with angle variations greater than 0.01°, 0.05°, 0.1° or even 0.4° and less than 3°, the pivot foot 8 also usually lies on the arresting holding device 7 with four, and at least with two line contacts 21 or 24.

In conceptional terms, the arresting device 6 permits a certain offset or angle offset (non-alignment) of the front attachment area 4 in the transverse direction Q, although without having to take into account an impairment in the position definition.

The front attachment area 4 is preferably designed in such a manner that the pivot movement according to arrow B is not fully defined with regard to the pivot angle, i.e. it is in the desired position without an end stop, so that the pivot angle is defined solely by the form-fit connection of the arresting foot 8 on the arresting holding device 7.

Figure 9B:
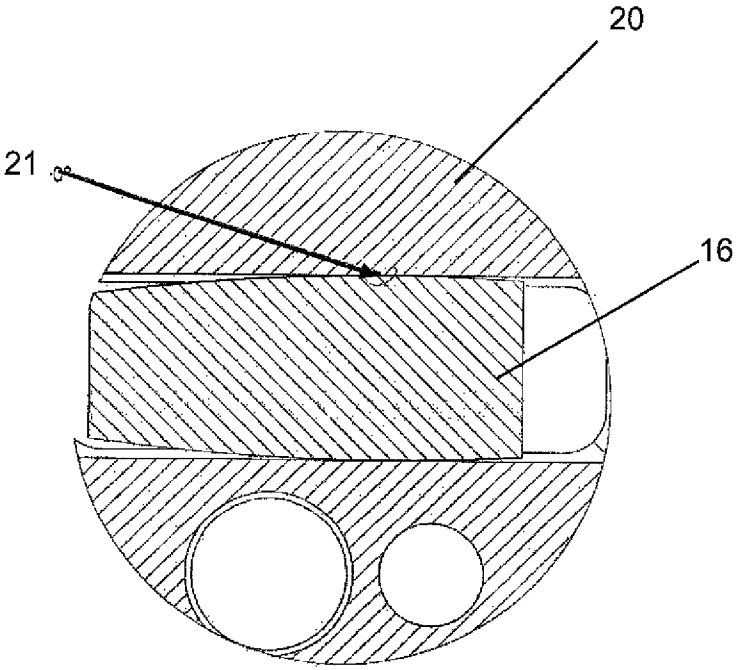
FIGS. 9*a, b* show a schematic side view and a longitudinal section through the arresting device FIGS. 10*a, b* show the arrangement shown in the preceding figures with a rotation of the arresting holding device and arresting foot around a pitch angle axis by 1°
Figure 9A:
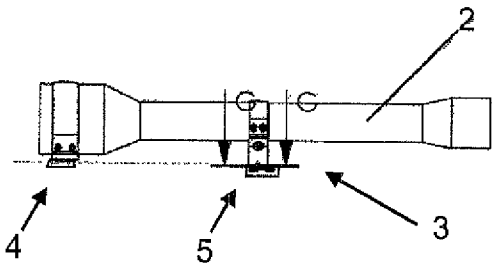
Figure 10B:
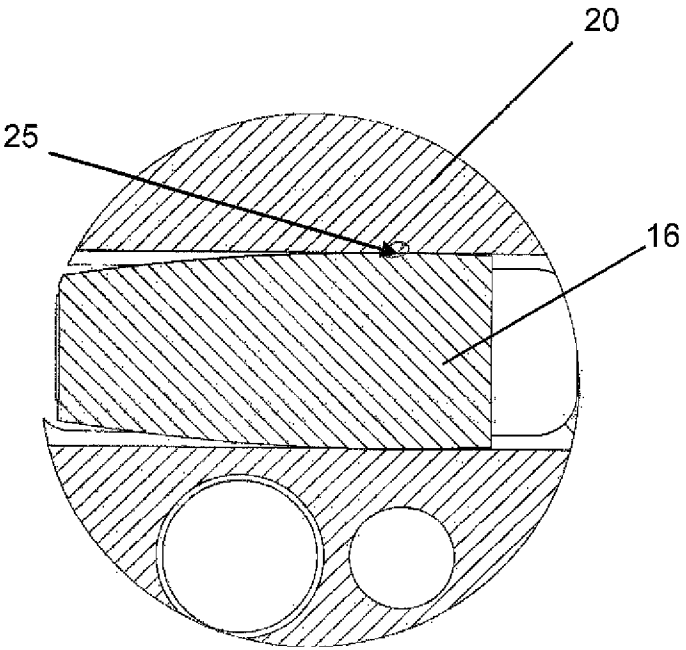
Figure 10A:
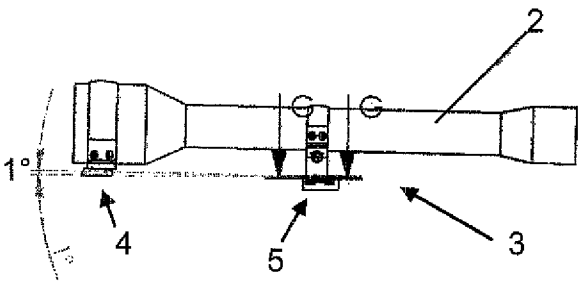
Figure 11B:
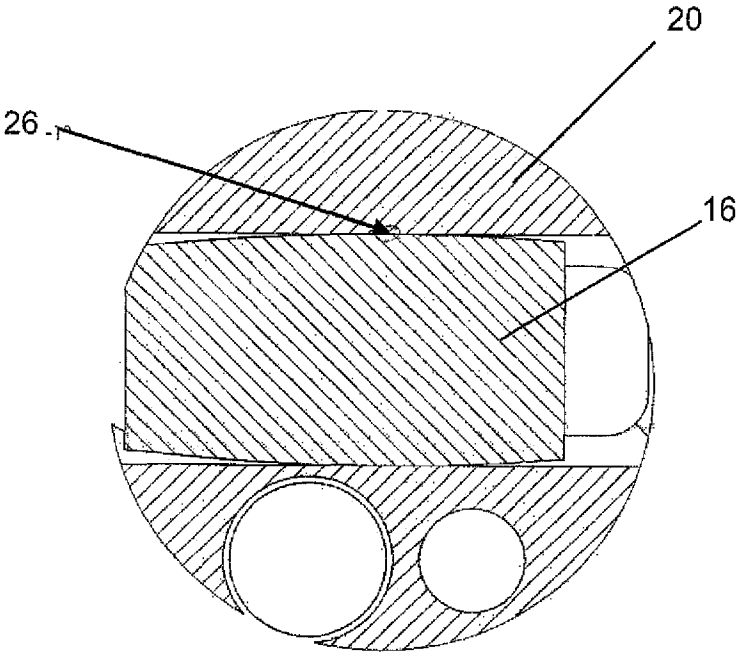
FIGS. 11*a, b* show the arrangement shown in the preceding figures with a rotation of the arresting holding device and arresting foot around a pitch angle axis by −1°
Figure 11A:
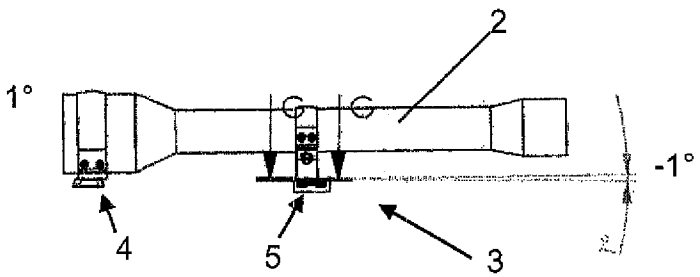

FIGS. 9 to 11 each show a schematic side view onto the arrangement shown in FIG. 1, and a longitudinal cross section parallel to the axial alignment or to the direction of travel through the contact area 21 with different angles around a pitch angle axis, wherein the pitch angle axis runs through the arrest vertically to the direction of travel, i.e. to the direction of travel of the firearm, and vertically to the radial direction. FIGS. 9*a, b* show the arranged with a relative position with regard to the pitch angle to each other of 0°, wherein the contact lines 21 correspond to the contact lines in FIG. 7. In FIGS. 10*a, b* and 11*a, b*, the arresting foot 8 and the arresting holding device 7 are turned towards each other by a pitch angle of +1° or −1°, wherein the contact lines 21 have moved and form new contact lines 25 and 26.

LIST OF REFERENCE NUMERALS

1 Firearm
2 Sighting telescope
3 Mounting system
4 Front attachment area
5 Rear attachment area
6 Arresting device
7 Arresting holding device
8 Arresting foot
9 Adjustment device
10 Ring holding device
11 Locking slide
12 Hook sections
13 Slits
14 Holding areas
15 Openings
16 Foot area
17 Underside
18 Support surfaces
19 Connection surfaces
20 Upper side
21 Contact lines
22 Through bores of the arresting holding device
23 Through bores of the arresting foot
24 New contact lines
25 New contact lines
26 New contact lines

The invention claimed is:

1. A mounting system for mounting a sighting telescope onto a firearm, wherein the firearm and/or the sighting telescope are aligned in a mounted position in an axial direction, the mounting system comprising:

a first mechanical interface configured to arrest the sighting telescope on the firearm; and a second mechanical interface configured to allow the sighting telescope to pivot from a mounted position on the firearm in a plane formed by the sighting telescope and the axial direction of the firearm, wherein the first mechanical interface includes an arresting foot attachable to a sighting telescope or a firearm; and an arresting holding device affixable to the firearm or the telescope, wherein the arresting foot comprises at least one support surface and the arresting holding device comprises at least one connection surface, wherein the support surface and the connection surface meet in a contact area so as to provide a form-fit connection of the arresting foot on the arresting holding device in a first radial direction, wherein the arresting foot and the arresting holding device form an arrest which detachably affixes the arresting foot in the other radial direction in an arresting position of the arrest, wherein the support surface and the connection surface are designed so that the arresting foot is arrested in the arresting holding device in different angle positions around at least two pivot axes relative to the arresting holding device, the at least two pivot axes selected from the group including:

a radially aligned pivot axis, which runs through the arresting holding device and/or the arresting foot and allows the arresting foot to be arrested in different yaw angle positions about the radially aligned pivot axis;

an axially aligned pivot axis, which allows the arresting foot to be arrested in different roll angle positions about the axially aligned pivot axis; and a transversely aligned pivot axis, which runs through the arresting holding device and/or the arresting foot and allows the arresting foot to be arrested in different pitch angle positions about the transversely aligned pivot axis.

2. The sighting telescope mounting system according to claim 1, wherein the pivot axis runs through the support surface and/or the connection surface and/or through the contact area.

3. The sighting telescope mounting system according to claim 1, wherein the support surface and the connection surface are designed so that the arresting foot is movable in the axial direction and is held in a form-fit manner in a transverse direction, which is aligned vertically to the axial and to the radial direction.

4. The sighting telescope mounting system according to claim 3, wherein the contact area comprises a plurality of point or line contacts which implement the form-fit hold in the transverse direction.

5. The sighting telescope mounting system according to claim 4, wherein the line contacts are aligned equally with the radial axis.

6. The sighting telescope mounting system according to claim 1, wherein the connection surface and/or the support surface form a funnel section in a cross-section vertical to the axial direction.

7. The sighting telescope mounting system according to claim 6, wherein the funnel section has wails that are straight or curved.

8. The sighting telescope mounting system according to claim 1, wherein the connection surface comprises a straight progression in a longitudinal section through the contact area.

9. The sighting telescope mounting system according to claim 1, wherein the support surface is curved in a longitudinal section through the contact area.

10. The sighting telescope mounting system according to claim 1, wherein the support surface has two support flanks which are curved in opposite directions in a longitudinal section, wherein the curves of the support flanks are sections of a shared circle, oval, shuttle form, a circle arc digon lens and/or a lemon form, or which supplement the forms or are designed as free-form surfaces.

11. The sighting telescope mounting system according to claim 1, wherein the support surface forms a mushroom head, a tapered head, a shuttle or free-form surfaces which correspond to their function.

12. The sighting telescope mounting system according to claim 1, wherein the arresting foot comprises at least two hook sections, wherein the support area is arranged on at least one hook section.

13. The sighting telescope mounting system according to claim 12, wherein the hook sections comprise a holding area for a locking slide.

14. The sighting telescope mounting system according to claim 3, comprising a pivot device designed to enable the sighting telescope to be swung back in onto the firearm during mounting of the sighting telescope mounting system, wherein the pivot device forms a fixed bearing for the transverse direction, in the axial direction and upwards, while simultaneously comprising a degree of play with regard to a pivot angle, wherein the pivot angle is defined by the arrest.

15. The sighting telescope mounting system according to claim 1, wherein the support surface and the connection surface are designed so that the arresting foot is arrested in the arresting holding device in different angle positions around each of the radially aligned pivot axis, the axially aligned pivot axis, and the transversely aligned pivot axis.

* * * * *